US008544509B2

(12) United States Patent
Lee, Jr. et al.

(10) Patent No.: US 8,544,509 B2
(45) Date of Patent: Oct. 1, 2013

(54) ADZER SKID ASSEMBLY AND METHOD OF USE

(75) Inventors: Milton H. Lee, Jr., Wetumpka, AL (US); George B. Pugh, III, Matthews, AL (US)

(73) Assignee: Knox Kershaw, Inc, Montgomery, AL (US)

( * ) Notice: Subject to any disclaimer, the term of this patent is extended or adjusted under 35 U.S.C. 154(b) by 306 days.

(21) Appl. No.: 12/901,866

(22) Filed: Oct. 11, 2010

(65) Prior Publication Data

US 2011/0094624 A1 Apr. 28, 2011

Related U.S. Application Data

(60) Provisional application No. 61/254,028, filed on Oct. 22, 2009.

(51) Int. Cl.
*B27C 5/00* (2006.01)

(52) U.S. Cl.
USPC ..... 144/4.4; 144/133.3; 144/134.1

(58) Field of Classification Search
USPC ..... 144/2.1, 4.4, 133.1, 133.3, 134.1
See application file for complete search history.

(56) References Cited

U.S. PATENT DOCUMENTS

| | | | | |
|---|---|---|---|---|
| 1,704,273 | A | 3/1929 | Alinder et al. | |
| 2,336,652 | A | 12/1943 | Talboys | |
| 2,527,668 | A | 10/1950 | Woolery | |
| 2,887,135 | A | 5/1959 | Fox et al. | |
| 2,923,331 | A | 2/1960 | Talboys | |
| 3,635,164 | A * | 1/1972 | Patton | 104/307 |
| 4,241,663 | A * | 12/1980 | Lund et al. | 104/16 |
| 4,848,426 | A | 7/1989 | Whitaker, Jr. | |
| 4,921,732 | A * | 5/1990 | Bounds | 427/325 |
| 7,000,659 | B1 | 2/2006 | McCray et al. | |

* cited by examiner

*Primary Examiner* — Bena Miller
(74) *Attorney, Agent, or Firm* — Kenneth M. Bush; Gerald M. Walsh; Bush Intellectual Property Law

(57) ABSTRACT

An adzer skid assembly having a frame and a base plate attached to the frame. The base plate has an adzer unit attached thereto. The frame has a receptacle for slidably attaching the frame to a railroad track maintenance machine so that up and down motion of the railroad track maintenance machine does not produce up and down motion of the adzer skid assembly. Hydraulic cylinders are attached to the baseplate and are attached to skids, wherein the hydraulic cylinders raise and lower the skids relative to the frame and baseplate and determine the cutting depth of the adzer unit. During the adze cutting process the adzer unit is supported entirely by the skids as the skids move across railroad crossties.

9 Claims, 5 Drawing Sheets

ADZER SKID ASSEMBLY AND METHOD OF USE

CROSS-REFERENCE TO RELATED APPLICATIONS

The present application claims priority to U.S. Provisional Patent Application No. 61/254,028, filed Oct. 22, 2009, the disclosure of which is incorporated herein by reference.

FIELD OF THE INVENTION

The present invention relates to railroad track maintenance machines and, more particularly, to an adzer skid assembly which connects to a railroad track maintenance machine and keeps the adzer cutting depth constant regardless of railroad track maintenance machine up/down movement that may occur as the crawlers of the machine negotiate uneven track and/or crosstie surfaces, and regardless of leaking of hydraulic cylinders in the machine that maintain vertical positioning of the adzer.

BACKGROUND OF THE INVENTION

A common railroad track maintenance machine for replacing rails of a railroad track uses a tie adzer to cut a smooth surface in a cross tie. Over a period of time, as trains pass along the rails of a railroad track, the weight of the cars pressing on the rails causes the tie plates, which support the rails, to cut a recess area in the top of the crossties. When an old rail has been removed, and the tie plates are taken up, the spike holes are plugged. It is then necessary to adze a smooth surface with an adzer on the crossties before the tie plates are reinstalled. It is important for the tie plates to fit flat against the crossties to adequately support the rail. The tie adzer has a cutterhead assembly that planes the surface on each crosstie where the tie plates will sit.

As a railroad track maintenance machine works along the track bed adzing the crossties, one side of the machine is supported by rail wheels running on the rail that is still in place. The other side of the machine is typically supported by crawler assemblies, since there is no rail in place for support. These crawler assemblies normally provide the motive power to move the machine along the track bed. A typical arrangement is for these crawler assemblies to be positioned near the ends of the crossties. Since the elevation of the crossties near their ends can vary considerably, the machine (and therefore the adzer head) tends to move up and down as the crawlers travel over the irregular crosstie ends. There is also the likelihood that ballast rocks may be on the crosstie ends, and when the crawlers travel over the rocks, this adds to the up and down movement. This means that the operator must maneuver the adzer head up/down to compensate for the machine's up/down movement to attain a smooth, consistent adzed surface on the crossties. This is very difficult to do, and typically the adzed cut is somewhat uneven. Also, typically, the cut is deeper than is actually needed, since the ideal depth is only deep enough to clean the "plate cut" from the tie. Also, in practice, the cutterhead often stalls, making it necessary to stop or reverse the machine. When this happens, the adzer head is usually raised. When the cut is started again, the proper depth has to be found again. Often times, the crosstie is gouged deeper than necessary, leaving an uneven cut that will not adequately support the tie plate. The operator has to be continuously aware of the load on the adzer head as he must slow the working speed when the adzer head starts to stall. He may only slow the machine while the head cuts through a tough spot, or he may have to stop or even reverse the machine a short distance. Although he might monitor the hydraulic gauge showing the pressure of the adzer head motor, he listens for indications of the adzer head load. Maintaining an optimum work speed is very difficult for the operator, especially since he is also trying to assure a smooth adzing cut.

It is also widely known in the industry to build the adzer machine with the crawlers spaced far enough apart that they can be positioned to run in the tie plate area, in line with the adzer head. The front crawler runs in the tie plate area ahead of the adzer head, and the rear crawler runs on the crossties behind the adzer head where a new, smooth surface has been planed. Since the crawlers are narrow enough to fit within the tie plate width, both crawlers can run on relatively smooth, even surfaces: the front crawler in the area where the plates were sitting, and the rear crawler on the freshly planed surface. This greatly improves the machine operation, since the crawlers are now running on smooth surfaces.

Operationally, it can be difficult to get the crawlers into the correct position. They must slide into position while bearing the weight of the machine since, at setup, at least one crawler must be positioned near the ends of the crossties. Once the crawlers are in place, the operator only needs to make minor adjustments to the depth of cut. However, there is always the possibility that the hydraulic cylinders that support the machine on the crawlers will gradually leak (bypass oil past the cylinder piston) letting the adzer head gradually cut deeper into the ties. Also, the cylinder supporting the adzer head might bypass allowing the adzer head to gradually move downward. As this happens, the operator has to adjust the controls to keep the adzer head at the proper depth.

It is also known that this type of machine can be equipped with electronic logic including linear transducers to measure any hydraulic cylinder movement that would result in adzer cutting depth changes. A programmable logic controller can be used to automatically shift hydraulic valves to keep hydraulic cylinders at preset extensions, thereby holding the adzer cutter head at a consistent depth. This system overcomes the problems caused by leaking from the hydraulic cylinders. However, this electronic arrangement is expensive and difficult to maintain. Mechanics have difficulty trouble shooting problems with this system, primarily due to lack of understanding. Also, this system is somewhat time consuming to setup, since a correct cutting depth has to be established manually, before the machine can be switched over to automatic depth control. Obviously, the crawlers have to be brought in line before establishing the correct cutting depth. This arrangement assumes that the crawlers are always running on a smooth reference surface, since the electronic system would not know any correction other than relative cylinder extensions. It is easy to see that the crawler running position is important and must be in the tie plate area. If the crawlers happen to travel over an uneven area, the resulting cut will be uneven.

U.S. Pat. No. 4,848,426 discloses a railroad track maintenance apparatus which has a forward cribber unit to remove ballast from between the crossties and a rear adzer unit to smoothen any irregularities in the crosstie surface during a track re-laying operation. U.S. Pat. No. 7,000,659 further discloses an adzer mount assembly having a slider box with a vertical slider and horizontal sliders. The vertical slider has an adzer which can be precisely positioned over a crosstie by hydraulic transverse movement of the slider box and vertical movement of the vertical slider. Because the horizontal sliders are mounted firmly to the frame of a railroad adzer machine the adzer is maintained firmly in position over the crosstie during cutting, allowing planeing and surfacing of the crosstie. However, what is further needed is an assembly which keeps the adzer cutting depth constant, regardless of the up/down movement of the railroad track maintenance machine as the crawlers of the machine negotiate the uneven track surfaces, and regardless of leaking of hydraulic cylinders in the machine that maintain vertical positioning of the adzer.

SUMMARY OF THE INVENTION

The present invention is an adzer skid assembly having a frame and a base plate attached to the frame, wherein the base plate provides for the attachment of an adzer cutting unit. There is also a receptacle on the frame for attachment of the frame to a railroad maintenance machine. The adzer skid assembly has a pair of skids which support the adzer skid assembly on crossties. Hydraulic cylinders are attached rotatably to the frame or base plate and are rotatably attached to skids by means of a linkage system, wherein the hydraulic cylinders raise and lower the skids relative to the frame and base plate. Thus, adzer cut depth is varied by raising or lowering the skids. The receptacle on the frame for attachment of the frame to a railroad maintenance machine engages an attachment means which is slidably attached to the railroad maintenance machine. As a result the up and down motion of the railroad maintenance machine and/or leaking of hydraulic cylinders in the machine that maintain vertical positioning of the adzer do not produce up and down motion of the adzer skid assembly. The adzer skid assembly further has an electronic speed control system that automatically adjusts the forward speed of the railroad maintenance machine to the rotational speed of a motor that drives the adzer cutting unit, so that a decrease in the rotational speed of the motor will cause a decrease in the forward speed of the railroad maintenance machine, and an increase in the rotational speed of the motor will cause as increase in the forward speed of the railroad maintenance machine up to a desired endpoint. When the machine is setup at the start of a track section that is to be adzed, the forward skid is lowered, establishing the cutting depth. As the machine works forward, the rear skid is lowered when it is clear to do so. Hydraulically, when the rear skid is lowered, the connection is made to put the adzer head into a "float" position, independent of any vertical control by the railroad maintenance machine. At this time, the adzer head is supported on the skids and is free to float, maintaining the selected cut. The railroad track maintenance machine is moved forward over the crossties while the adzer unit is supported by the adzer skid assembly and adzes each crosstie.

An advantage of the present invention is the elimination of unwanted crosstie gouging.

Another advantage is the adze depth can be quickly and easily changed using shims and simple screw adjustments when necessary.

Another advantage is operation of a railroad maintenance machine under an even load.

Another advantage is the adzer head hydraulic motor operates at an even pressure.

Another advantage is the automatic control of the forward speed of the railroad maintenance machine.

Another advantage is an increase in the life of adzer bits and crossties, and tie plates are able to provide better support for the rails.

DETAILED DESCRIPTION OF THE INVENTION

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
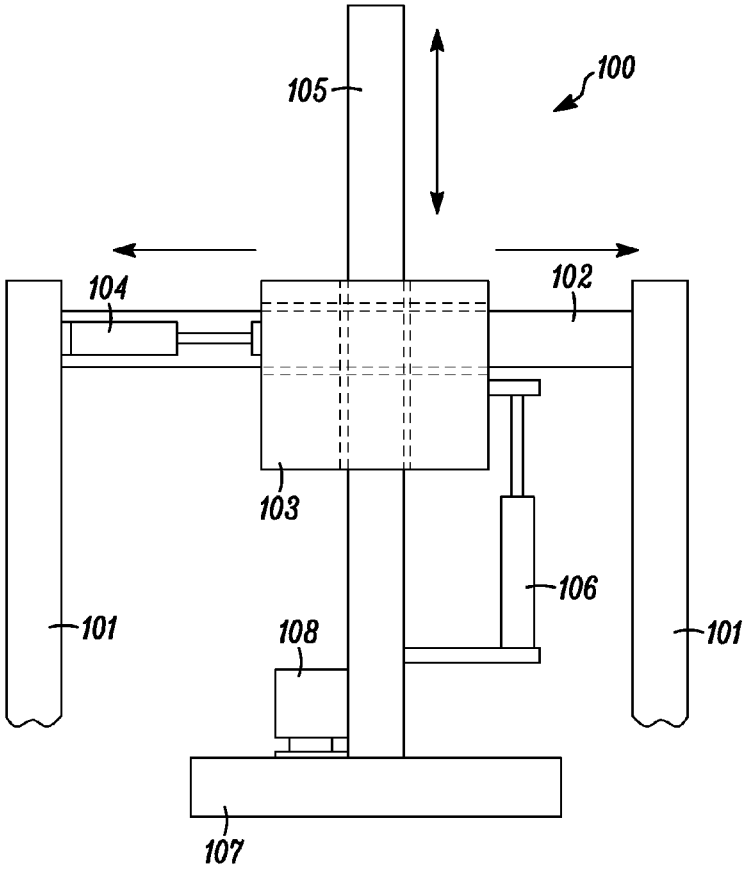
(Prior Art) FIG. 1
FIG. 1 illustrates a side view of an adzer mount assembly in a railroad maintenance machine.

FIG. 1 illustrates a side view of an adzer mount assembly 100 as described in U.S. Pat. No. 7,000,659, incorporated herein by reference. The adzer skid assembly of the present invention is, preferably, attached to the vertical slider 105 of this adzer mount assembly 100. However, the adzer skid assembly of the present invention may be used with any adzer mount assembly in any railroad maintenance machine. The adzer mount assembly 100 has mounting frames 101 attached to a railroad track maintenance machine. A horizontal slider 102 passes through a slider box 103 and is attached to each of the mounting frames 101. A horizontal slide cylinder 104 is attached to a mounting frame 101 and the slider box 103. A vertical slider 105 also passes through the slider box 103. A vertical slide cylinder 106 is attached to the vertical slider 105 and the slider box 103. An adzer unit 107 is attached to the bottom of the vertical slider 105. A motor 108 drives the adzer unit 107. The horizontal slide cylinder 104 moves the slider box 103 horizontally back and forth across the horizontal slider 102, which moves the adzer unit 107 back and forth horizontally. The vertical slide cylinder 106 moves the vertical slider 105 up and down through the slider box 103, which moves the adzer unit 107 up and down vertically.

Figure 2:
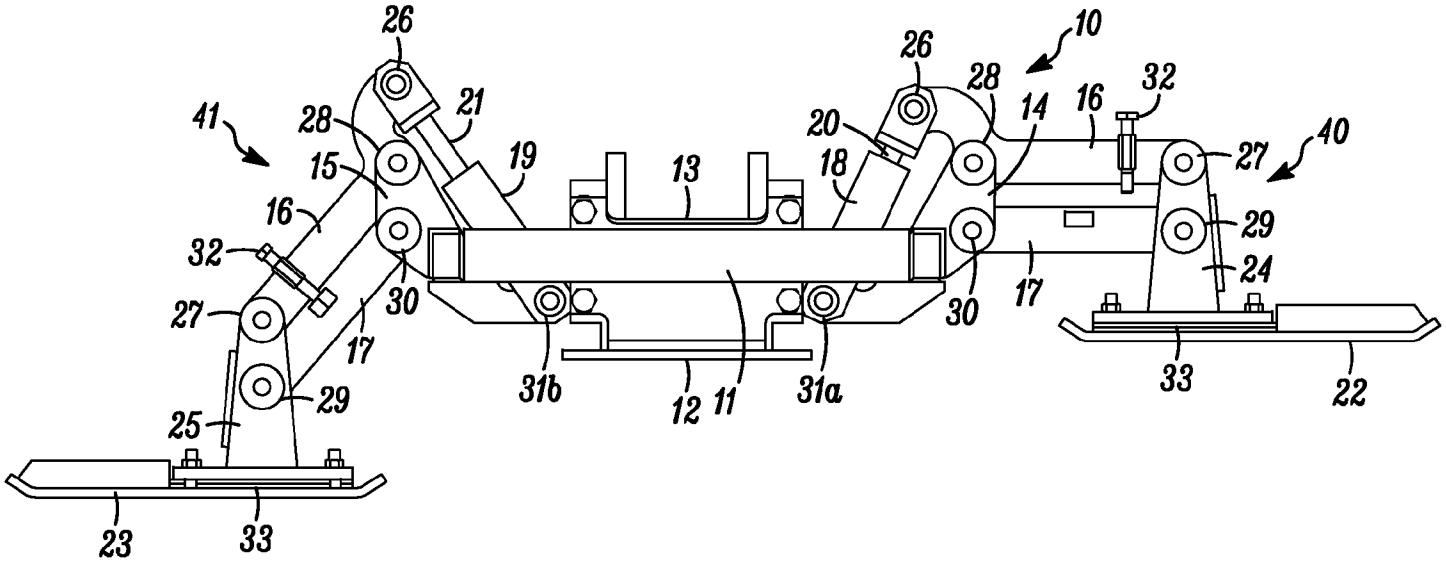
FIG. 2 shows a side view of the adzer skid assembly of the present invention.

FIG. 2 shows a side view of the adzer skid assembly 10 of the present invention. The skid assembly 10 has a frame 11 with a base plate 12 for supporting an adzer unit 42 and a vertical slider receptacle 13 for attachment of the adzer skid assembly 10 to a vertical slider 105 of an adzer mount assembly 100. Hydraulic cylinders 18 and 19 are attached rotatably to skids 22 and 23, respectively, by means of a linkage system. A first cylinder linkage mount 14 is attached to one side of frame 11 and a second cylinder linkage mount 15 is attached to an opposite side of frame 11. An upper skid link 16 is attached rotatably to each cylinder linkage mount 14, 15 at linkage connection 28. A lower skid link 17 is attached rotatably to each cylinder linkage mount 14, 15 at linkage connection 30.

Adzer skid assembly 10 has a first skid 22 positioned at a front end 40 of the adzer skid assembly 10, and a second skid 23 positioned at the rear end 41 of adzer skid assembly 10. Skid 22 has a skid link mounting bracket 24 and skid 23 has a skid link mounting bracket 25. Upper skid links 16 are attached rotatably to each skid link mounting bracket at linkage connections 27. Lower skid links 17 are attached rotatably to each skid link mounting bracket 24, 25 at linkage connections 29.

A first hydraulic cylinder 18 is mounted rotatably to adzer base plate 12 at connection 31*a*, and the piston rod 20 of hydraulic cylinder 18 is connected rotatably to upper skid link 16 on cylinder linkage mount 14 at connection 26 near linkage connection 28. Accordingly, the operation of hydraulic cylinder 18 will raise and lower skid 22. A second hydraulic cylinder 19 is mounted rotatably to adzer base plate 12 at connection 31*b* and the piston rod 21 of hydraulic cylinder 19 is connected rotatably to upper skid link 16 on cylinder linkage mount 15 at connection 26 near linkage connection 28. Accordingly, the operation of hydraulic cylinder 19 will raise and lower skid 23.

Each upper skid link 16 may have an adjusting screw 32 which can engage lower skid link 17 to limit the degree to which hydraulic cylinders 18 and 19 can lower skids 22 and 23 relative to frame 11 and base plate 12. Each skid 22, 23 can have shims 33 positioned between skids 22, 23 and skid mounting brackets 24, 25, respectively, to vary the space therebetween.

Figure 3:
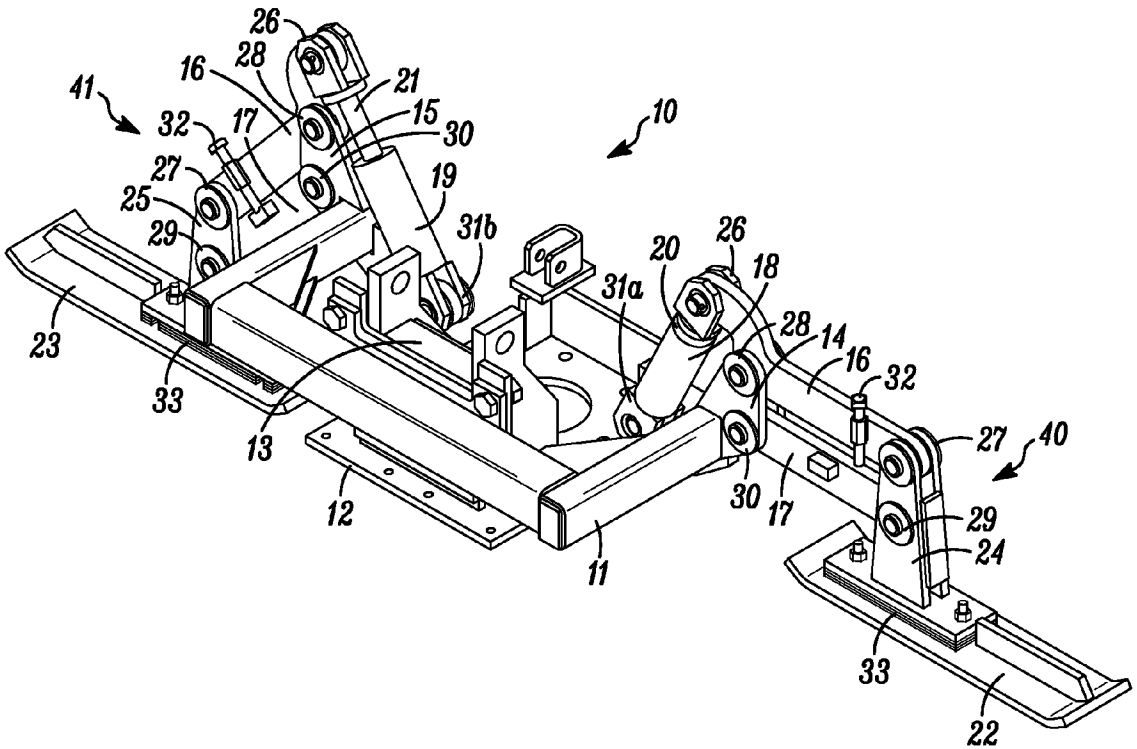
FIG. 3 shows a top perspective view of the adzer skid assembly.
Figure 4:
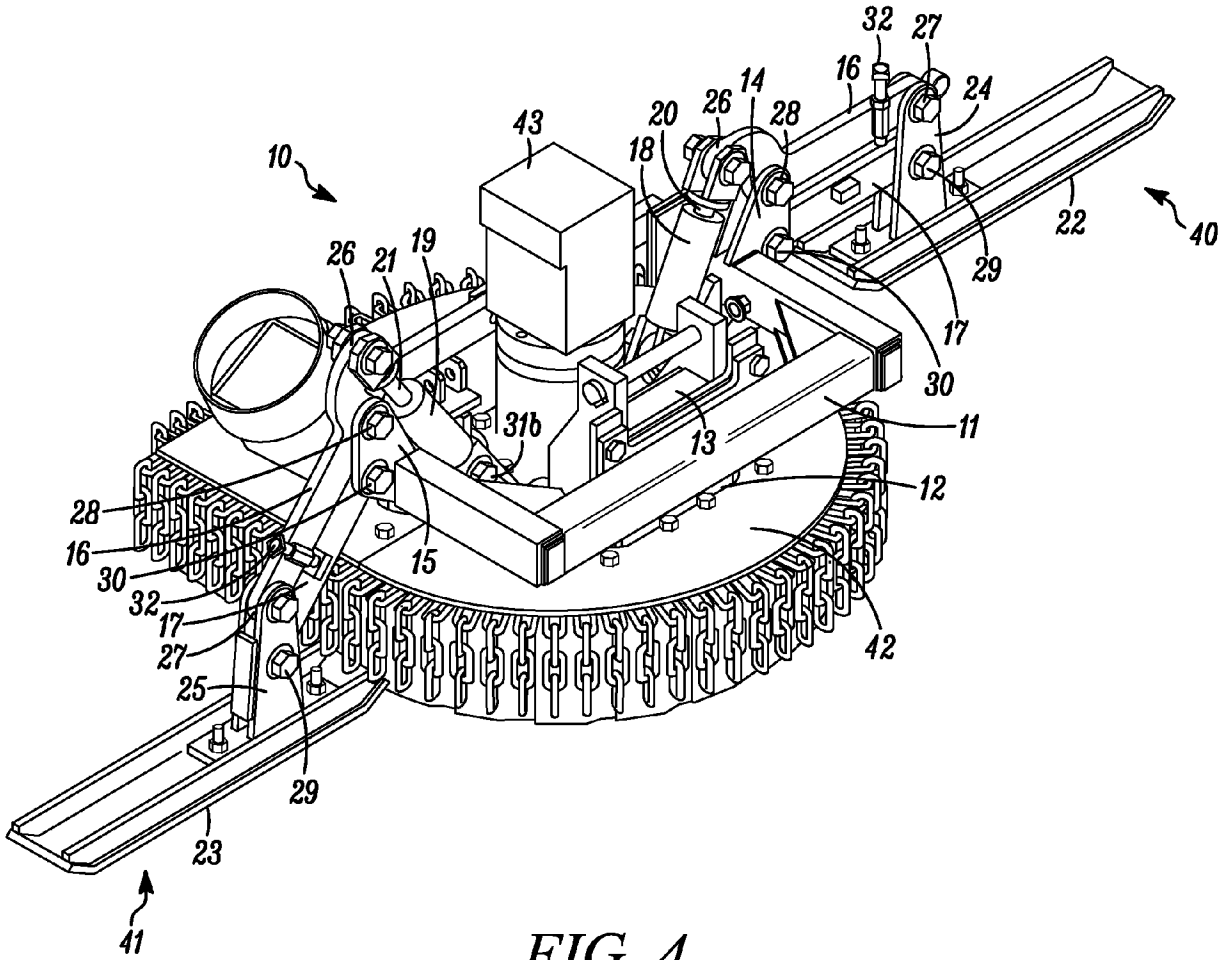
FIG. 4 shows a top perspective view of the adzer skid assembly with an adzer unit in place.

FIG. 3 shows a top perspective view of adzer skid assembly 10. FIG. 4 shows another top perspective view of adzer skid assembly 10 with an adzer head or unit 42 attached to base plate 12 and a motor 43 connected to adzer unit 42. The present invention further contemplates an adzer head or unit with a skid assembly wherein the adzer head is supported entirely on crossties by means of skids that move across the crossties. The distance between the skids and the adzer unit is fixed, or is adjustable and made fixed after making a desired adjustment. The adzer unit is slidably attached to a railroad track maintenance machine so that up and down (vertical) motion of the railroad track maintenance machine does not produce up and down motion of the adzer unit, and the railroad track maintenance machine does not support the weight of the adzer unit and skid assembly.

Activation of the hydraulic cylinders 18, 19 causes the piston rods 20, 21 to extend out of the hydraulic cylinders 18, 19. As the piston rods 20, 21 extend out, the skids 22, 23 are pushed downward relative to the adzer unit 42. The skids 22, 23 engage crossties of a railroad track and move across the crossties as the crawlers of the railroad track maintenance machine move the machine forward. As the piston rods 20, 21 extend out of the hydraulic cylinders the adzer unit 42 is elevated above the crosstie, and as the piston rods are withdrawn into the hydraulic cylinders 18, 19 the adzer unit 42 is lowered towards the crosstie. Thus, by adjusting the position of the adzer unit 42 with the hydraulic cylinders 18, 19, the depth of the cut in the crosstie by the adzer unit can be made precisely as desired.

Figure 5:
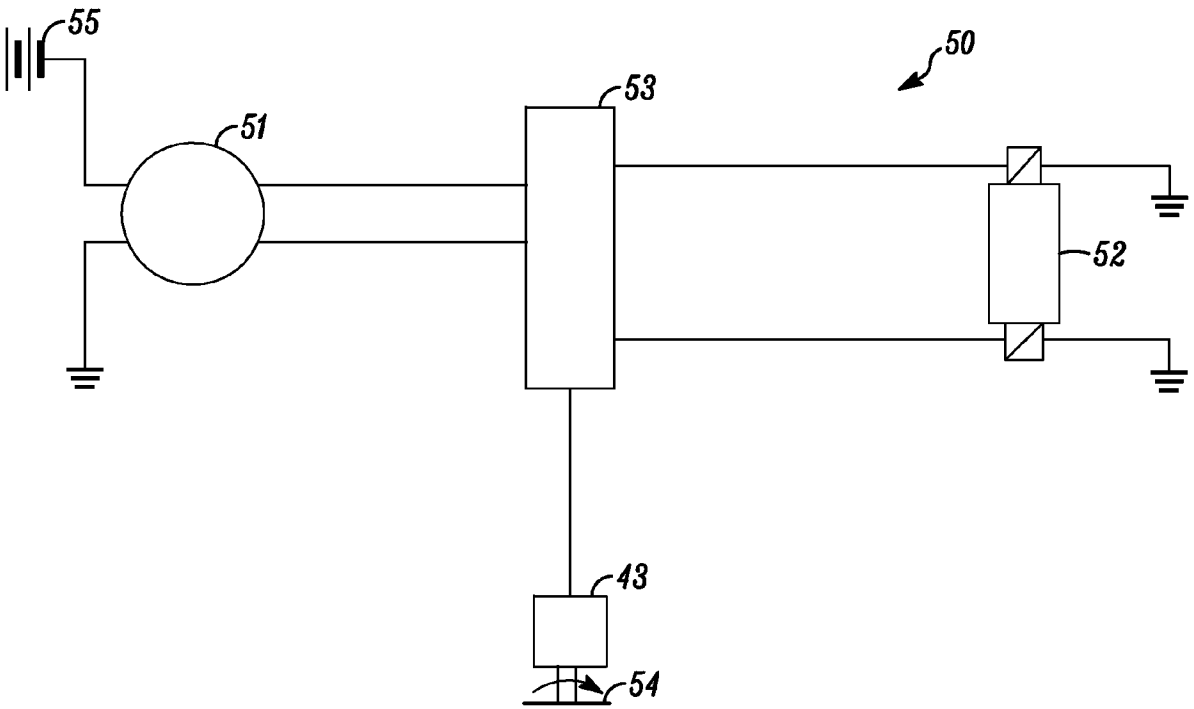
FIG. 5 shows a diagram of an electronic speed control system that automatically adjusts the speed of the crawlers of the railroad maintenance machine relative to the rotational speed of the adzer unit hydraulic motor.

The adzer skid assembly of the present invention is particularly effective when used with the Model KKA 1000 Kribber Adzer Machine (Knox Kershaw Inc, Montgomery, Ala.) although it can be used with any railroad track maintenance machine. An automatic speed control system can also be used with the adzer skid assembly in conjunction with the railroad track maintenance machine. This automatic speed control system allows the machine to achieve maximum productivity. FIG. 5 shows a diagram of an electronic speed control system 50 that automatically adjusts the speed of the crawlers of the railroad track maintenance machine relative to load on the adzer unit motor 43. The working speed of the machine is automatically controlled dependent on the load on the adzer head. As the adzer head load increases beyond a predetermined point, the working speed automatically slows to allow the adzer head to regain rotational speed. When the adzer head speed builds back to normal, the machine working speed increases to the operator selected position.

In operation, the machine operator gets the machine started into the adze cut as he maneuvers the machine into place and lowers the skids to control the cutting depth. After he has the work underway, he sets the machine working speed by adjusting the crawler speed control potentiometer 51 to a setting that sends the desired electronic signal to the hydraulic valves 52 that control the hydraulic motors that control the forward speed of the crawlers to advance the railroad track maintenance machine. Then he switches the automatic speed control 'on'. This electrically connects an electronic microcontroller 53 into the control circuitry. The microcontroller 53 now controls the signal going to the hydraulic valves 52 that control the hydraulic motors that control the crawler speed. Preferably, an encoder 54 on the adzer head hydraulic motor 43 measures the rotational speed of the motor 43 as a measure of the load on the adzer head and adzer unit motor 43. The load on the adzer head or adzer unit motor 43 may also be measured by measuring engine load or adzer unit motor pressure. This motor speed information is continuously fed into the microcontroller 53. As long as the rotational speed is above a predetermined level, the microcontroller 53 is programmed to keep the working speed at the setting adjusted by the operator initially. When the adzer head load increases, the motor 43 rotational speed drops. When the rotational speed drops below a predetermined level, the microcontroller 53 slows the crawler speed, allowing the adzer head to 'catch up'. If the load on the adzer should continue to increase, the machine will continue to slow or actually stop. When the load decreases enough for the motor speed on the adzer to get back to the predetermined level, the microcontroller 53 signals the crawlers to increase in speed at a controlled rate. If the motor 43 maintains rotational speed above the predetermined level, the forward working speed will increase until the operator-chosen forward working speed is attained.

The operator has to simply monitor the machine's functions as it works along the track. He feels the machine's forward speed gradually slow and increase again as the automatic speed control system functions. He hears the sound of the cut change as the head adzes a hard tie, and feels the speed control system respond. As the sound returns to normal, he feels the machine increase in speed. The operator's job is easier because the operator no longer has to make forward speed changes manually with this automatic system 50. The machine handles the changing conditions, and the operator only has to assure that the cutting of the adzer is producing the desired result. The automatic speed system has a power supply 55.

The adzer unit is connected to the skid assembly which keeps the adzer cutting depth constant regardless of railroad track maintenance machine up/down movement as the machine's crawlers negotiate the uneven track surfaces. The cutting depth of the adzer remains constant regardless of hydraulic cylinder drift in the railroad track maintenance machine. Railroad track maintenance machine setup on a railroad track is much easier for the skid assembly than having to maneuver to get the machine's crawlers in line. Once adzing starts, the automatic depth is set. It is not necessary to manually attain the cutting depth and then switch over to automatic mode. When the machine is setup at the start of a track section that is to be adzed, the forward skid is lowered, establishing the cutting depth. As the machine works forward, the rear skid is lowered when it is clear to do so. Hydraulically, when the rear skid is lowered, the connection is made to put the adzer head into a "float" position. At this time, the adzer head is supported on the skids and is free to "float", maintaining the selected cut. Both ports of a hydraulic cylinder in the railroad track maintenance machine that raise/lower the adzer head are now vented to the hydraulic reservoir. The hydraulic cylinders supporting both skids remain pressurized eliminating any cylinder drifting problems, while the railroad track maintenance machine may move up and down as it moves forward on the crossties. Accordingly, the adzer skid assembly is not affected by up and down movements of the railroad track maintenance machine. The adze cut depth can be quickly and easily changed using one or more shims in the skids and/or one or more screw adjustments in the linkage system.

The skid arrangement, which eliminates unwanted crosstie gouging, makes it possible to incorporate an automatic speed control system that allows the engine to operate under a more even load. Also the adzer head hydraulic motor operates at a more even pressure. By electronically monitoring engine load and/or adzer head motor pressure and/or adzer head motor rotational speed, it is possible to automatically control the machine forward work speed. If the adzer head encounters a particularly hard crosstie or a severely tie plate cut crosstie resulting in a higher power requirement, the machine will automatically slow or stop. When the load decreases, the machine will resume the desired working speed that has been set by the operator. This feature optimizes production as the machine can move forward at the fastest work pace possible. The difficult aspects of machine operation are eliminated with the combination of the skid system and the automatic speed control system. The operator does not have to be concerned with trying to assure a smooth, consistent, minimal adzed cut. He also does not have to be concerned with varying the machine speed as the load changes.

Since this skid arrangement and automatic speed control are able to establish a minimal adzed cut depth and an optimum production rate, they offer many material advantages. Adzer bit life is greatly increased since the load on the bits is much more even, eliminating the excessive gouging into the crossties. This results in a cost savings since bits require replacement less often and fewer bits are used. Also, crosstie life will be increased since only the minimal amount is cut away to establish a new surface. There are significant cost savings since crossties will require replacement less often. Since the crossties are adzed more evenly, the tie plates are able to provide better support for the rails. There will probably be fewer broken rails and the track structure should remain in stable condition longer. Adzer head component life is increased since the loading is more even with the elimination of the frequent stall conditions.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the skids may be fashioned in any suitable size or shape. The skids may be constructed of any suitable materials such as metal, plastic, wood, or a combination thereof. Any suitable linkage system may be used between the hydraulic cylinders and the skids. Any suitable type of adzer unit may be used. Electric motors may be used in place of hydraulic motors.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. An adzer skid assembly, comprising:

a) a frame and a base plate attached to said frame, said base plate providing attachment of an adzer unit;

b) a receptacle on said frame for attachment of said frame to a railroad track maintenance machine; and c) hydraulic cylinders attached to said frame or base plate and attached to skids, wherein said hydraulic cylinders raise and lower said skids relative to said frame and said base plate.

2. The adzer skid assembly of claim 1 wherein said base plate has an adzer unit attached thereto.

3. The adzer skid assembly of claim 1 wherein adze cut depth is varied by raising and lowering said skids.

4. The adzer skid assembly of claim 1 wherein adze cut depth is varied by one or more shims on said skids.

5. The adzer skid assembly of claim 1, further comprising an electronic speed control system that automatically adjusts the forward speed of the railroad track maintenance machine relative to the rotational speed of a motor that drives an adzer unit, so that a decrease in rotational speed of the motor will cause a decrease in the forward speed of the railroad track maintenance machine, and an increase in rotational speed of the motor will increase the speed of the railroad track maintenance machine up to a desired endpoint.

6. An adzer skid assembly, comprising:

a) a frame and a base plate attached to said frame, said base plate providing attachment of an adzer unit;

b) a receptacle on said frame for attachment of said frame to a railroad track maintenance machine;

c) hydraulic cylinders attached rotatably to said frame or base plate and attached rotatably to skids by means of a linkage system, wherein said hydraulic cylinders raise and lower said skids relative to said frame and said base plate; and d) an electronic speed control system that automatically adjusts the forward speed of the railroad track maintenance machine relative to the rotational speed of a motor that drives an adzer unit, so that a decrease in rotational speed of the motor will cause a decrease in the forward speed of the railroad track maintenance machine, and an increase in rotational speed of the motor will increase the speed of the railroad track maintenance machine up to a desired endpoint.

7. The adzer skid assembly of claim 6 wherein said base plate has an adzer unit attached thereto.

8. The adzer skid assembly of claim 7 wherein adze cut depth is varied by raising and lowering said skids.

9. The adzer skid assembly of claim 8 wherein adze cut depth is varied by one or more shims on said skids and/or one or more screws in said linkage system.

* * * * *